US005119711A

United States Patent [19]

Bell et al.

[11] Patent Number: 5,119,711

[45] Date of Patent: Jun. 9, 1992

[54] MIDI FILE TRANSLATION

[75] Inventors: James L. Bell, Saratoga, Calif.; Ronald J. Lisle, Cedar Park, Tex.; Daniel J. Moore, Austin, Tex.; Steven C. Penn, Georgetown, Tex.

[73] Assignee: International Business Machines Corporation, Armonk, N.Y.

[21] Appl. No.: 608,114

[22] Filed: Nov. 1, 1990

[51] Int. Cl.[5] ..... G10H 1/06; G10H 7/00

[52] U.S. Cl. ..... 84/622; 84/645

[58] Field of Search ..... 84/609-614, 84/622-625, 634-638, 645

[56] References Cited

U.S. PATENT DOCUMENTS 4,960,031 10/1990 Farrand ..... 84/609

4,998,960 3/1991 Rose et al. ..... 84/622

*Primary Examiner*—Stanley J. Witkowski

*Attorney, Agent, or Firm*—Kenneth C. Hill

[57] ABSTRACT

A system and method for translating MIDI files is used with a sequencer and synthesizer. When a MIDI file is imported into a system, the file is scanned and voice assignment information extracted. This information is stored in a converted file. If desired, the extracted information can be stored using MIDI system exclusives. This allows either any original program change information, or the extracted information, to be used during a performance of the converted MIDI file.

13 Claims, 5 Drawing Sheets

```
Set default channel to "not defined" for all tracks
Do until no more MIDI elements
  IF Meta-Event
    IF "MIDI Channel Prefix" Meta Event
     Set default channel for track in which encountered
    ELSE
      IF "Instrument Name" Meta-Event
        IF voice can be identified from ASCII text
          IF Channel can be identified from ASCII text
            IF identified channel is active in file
             IF Channel not already assigned
               Set identified voice to identified channel
             ELSE
            ELSE
              IF Channel not already assigned
                Set voice to most active channel
              ELSE
          ELSE
            IF default channel is specified and channel is
            active in file
              IF Channel not already assigned
                Set identified voice to default channel
              ELSE
            ELSE
              IF Channel not already assigned
                Set voice to most active channel
              ELSE
            ELSE
      ELSE
        Process non voice assignment MIDI Meta-Event
    ELSE
      Process non Meta-Event MIDI element
  End DO
```

*Fig. 4* track 1 ... { IN. NAME, TROMBONE } ... [ NOTE ON, CHAN3 ] ... [ NOTE ON, CHAN4 ] ...

track 2 ... { CHANNEL PREFIX, CHAN1 } ... { IN. NAME, TUBA } track 3 ... { IN. NAME, "SASSY VIOLIN ON CHANNEL 2, AND 5 FOR THE CYMBAL" } ...

*Fig. 5a*

... < SYS EX: CHAN1 = 3, CHAN2 = 2, CHAN3 = 1, CHAN4 = 1, CHAN5 = 4, 60X > ...

*Fig. 5b*

| | |
|---|---|
| conversion tables | trombone/1 |
| | touba/3 |
| | tuba/3 |
| | symbol/4 |
| | cymbal/4 |
| | violin/2 |
| | . |
| | . |
| | . |

*Fig. 5c*

MIDI FILE TRANSLATION

BACKGROUND OF THE INVENTION

1. Field of the Invention

The present invention relates generally to the use of MIDI files with musical synthesizers, and more specifically to a system and method for translating certain portions of MIDI files.

2. Description of the Prior Art

The Musical Instrument Digital Interface (MIDI) was established as a hardware and software specification which would make it possible to exchange information between different musical instruments or other devices such as sequencers, computers, lighting controllers, mixers, etc. A description of the interface can be found in MIDI 1.0 DETAILED SPECIFICATION, document version 4.1, Jan. 1989. The various uses and details of the MIDI specification have been well documented in the art.

A MIDI performance can be stored in a data file for later replay. Such file contains data describing various musical events, such as the turning on or off of various notes. The data also defines changes in performance parameters such as volume, tremoloe, etc. Some synthesizers can emulate many different musical instruments, and generate sounds which are not matched by any musical instruments. The different instrument sounds which can be played are commonly referred to as "voices".

A controller known as a sequencer reads a data file and generates a serial data stream used to control synthesizers and other instruments. The serial data stream is generated in real time, and contains "events" for controlling synthesizers and other instruments. The receiving synthesizer acts upon an event in a serial data stream as soon as it is received. The MIDI specification provides for 16 channels in the serial data stream, and each event identifies a channel to which it applies.

One type of event, called a "program change" in MIDI, defines the mapping of voices to MIDI channels. A program change event includes a channel number (1 to 16), and a number indicating which voice is to be played on that channel. Thus, for example, if instrument number 27 is defined to be a celeste, a program change on channel 1 with instrument number 27 tells the synthesizer to use its celeste voice, or nearest equivalent, on channel 1. Unfortunately, the usage of voice numbers by synthesizers has not been standardized, so that any given voice number can represent different voices on different synthesizers.

Until now, a knowledgeable MIDI programmer has been required to edit a MIDI file to match program changes to any synthesizers used to replay a MIDI performance. When distributed, many MIDI files do not include any program changes as a result of the non-standardization problem; instead, comments which describe the voices to be used for each channel are often included in so-called "meta-events" which are used to carry instrument names. The MIDI programmer reads these instrument name meta-events, and inserts any required program changes into the file using a sophisticated editor.

It would be desirable to provide a system and method for automatically determining the voices required by a MIDI file, and inserting the proper program change events into the file. It would be further desirable for such a system and method to leave all of the original data in the file in intact.

SUMMARY OF THE INVENTION

It is therefore an object of the present invention to provide a system and method for automatically converting a MIDI file to include voice (program change) information.

It is another object of the present invention to provide such a system and method which does not remove any program change information which may already be present in the file.

It is a further object of the present invention to provide such a system and method which, at the time the performance defined by the MIDI file is played back, can utilize either the original program change information or newly included program change information.

Therefore, according to the present invention, a system and method for translating MIDI files is used with a sequencer and synthesizer. When a MIDI file is imported into a system, the file is scanned and voice assignment information extracted. This information is stored in a converted file. If desired, the extracted information can be stored using MIDI system exclusives. This allows either any original program change information, or the extracted information, to be used during a performance of the converted MIDI file.

BRIEF DESCRIPTION OF THE DRAWINGS

The novel features believed characteristic of the invention are set forth in the appended claims. The invention itself however, as well as a preferred mode of use, and further objects and advantages thereof, will best be understood by reference to the following detailed description of an illustrative embodiment when read in conjunction with the accompanying drawings, wherein:

FIG. 4 is a pseudo-code outline of a preferred method according to the present invention; and FIGS. 5(*a*)–5(*c*) are examples illustrating several features of the present invention.

DETAILED DESCRIPTION OF THE INVENTION

Various MIDI related details, such as formats of various MIDI events, will not be described herein. This information is well known in the art, and is available from multiple sources. Practitioners skilled in the art will be able to implement various features of the invention with reference to the description below and to such prior publications.

Figure 1:
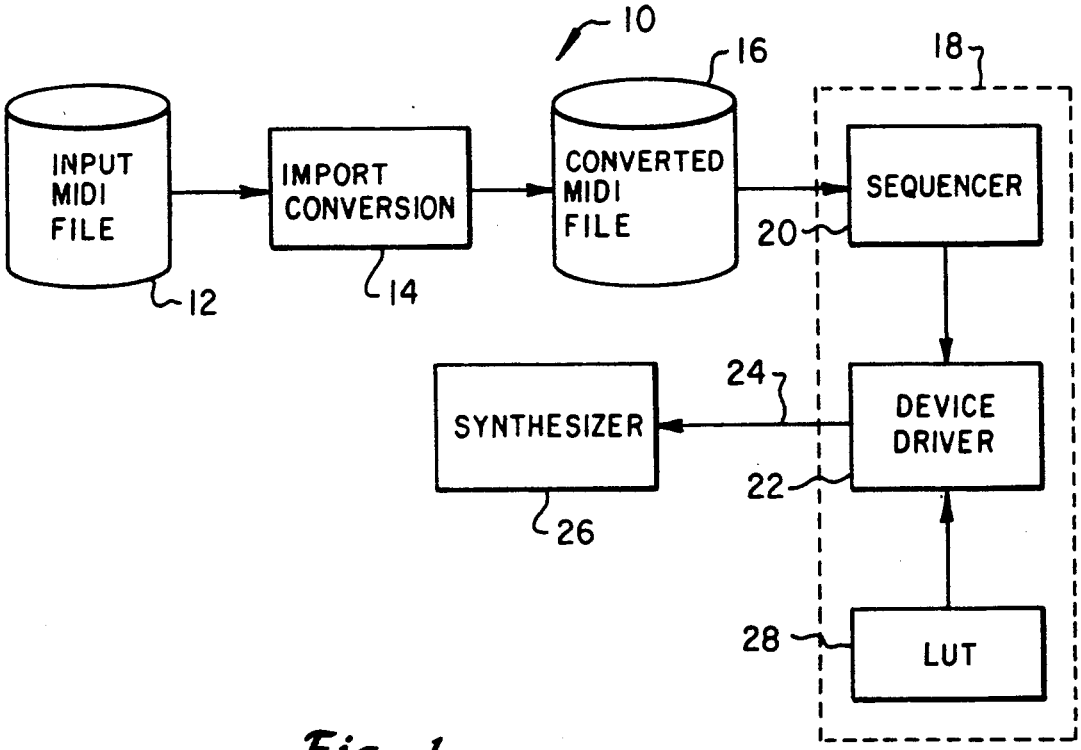
FIG. 1 is block diagram of a system according to the present invention.

Referring to FIG. 1, a system useful for playback of musical performances contained in MIDI data files is referred to generally with reference number 10. A performance is defined by a MIDI file 12 used as input to the system. A import converter program 14 reads the input file 12, and generates a converted MIDI file 16.

A sequencing sub-system 18 reads the converted file 16 into a sequencer 20. The sequencer 20 performs timing and other calculations based on the information in the file 16, and generates a MIDI data stream as known in the art. This data stream is sent to a device driver 22 which controls output hardware (not shown) and places the data stream on a serial output line 24. Serial output line 24 is connected to one or more musical instruments, represented by the single synthesizer block 26.

As will be described in more detail below, the import converter 14 parses selected portions of the input file 12, and automatically determines a mapping of instrument voices to MIDI data channels. Information defining this mapping is placed into the converted MIDI file 16. If desired, the converted file 16 can be manually edited as known in the art in order to modify any program changes which were automatically placed into the converted file 16, and to add program changes which the converter 14 was not able to extract from the input file 12.

A standard mapping of voices to voice numbers is preferably used by the converter 14. This mapping is independent of the precise identity of the synthesizer 26. When a program change which uses a standardized voice number is detected by the device driver 22, it cross references that number against a look up table 28 which is specific to the particular synthesizer 26 which is connected to output line 24. The look up table 28 contains a listing of instrument numbers for the synthesizer 26 which match the standard voice numbers which were placed into the converted file 16. This allows the device driver 22 to perform the necessary conversions at the time the MIDI data stream is placed on the output line 24. If the synthesizer 26 is changed for another model having an incompatible voice numbering system, it is necessary only to change the look up table 28 to one corresponding to the new synthesizer 26. It is not necessary to modify the device driver 22 or any other part of the system, so that synthesizer 26 changes are easily handled with a minimum amount of effort.

In many situations, it is desirable for the converted file 16 to contain all of the information which was original in the input file 12. If the input file 12 was originally written for use with a particular synthesizer, it may contain program change events which are specific for the target synthesizer. In order to keep the originally program change events from interfering with those extracted by the importer 14, the extracted program changes are preferably encoded and placed into system exclusive events in the converted file 16. As known in the art, system exclusive events are ignored by synthesizers which do not specifically recognize them. Therefore, if the converted MIDI file 16 is played by a sequencer which is not connected to a device driver which recognizes these system exclusive events, they are simply passed along to the synthesizer and ignored.

The device driver 22 can be operated in one of two different modes, depending on which synthesizer 26 is attached and the desires of the user. If it is desired that the original program change information be passed to the synthesizer 26, a flag is set in the device driver to ignore the program change events contained within system exclusive events. In this manner, the synthesizer 26 responds to program change events in the usual way, and is not required to be able to interpret the system exclusive events which were placed into the converted file 16.

If the extracted program changes, placed into the converted file 16 by the importer 14, are desired, a flag is set to ignore the original program change events which are output from the sequencer 20. The device driver simply strips these events out, and does not place them on the output line 24. Program change events which are contained within system exclusive events from the sequencer 20 are converted to program change events and placed on the output line 24.

Figure 2:
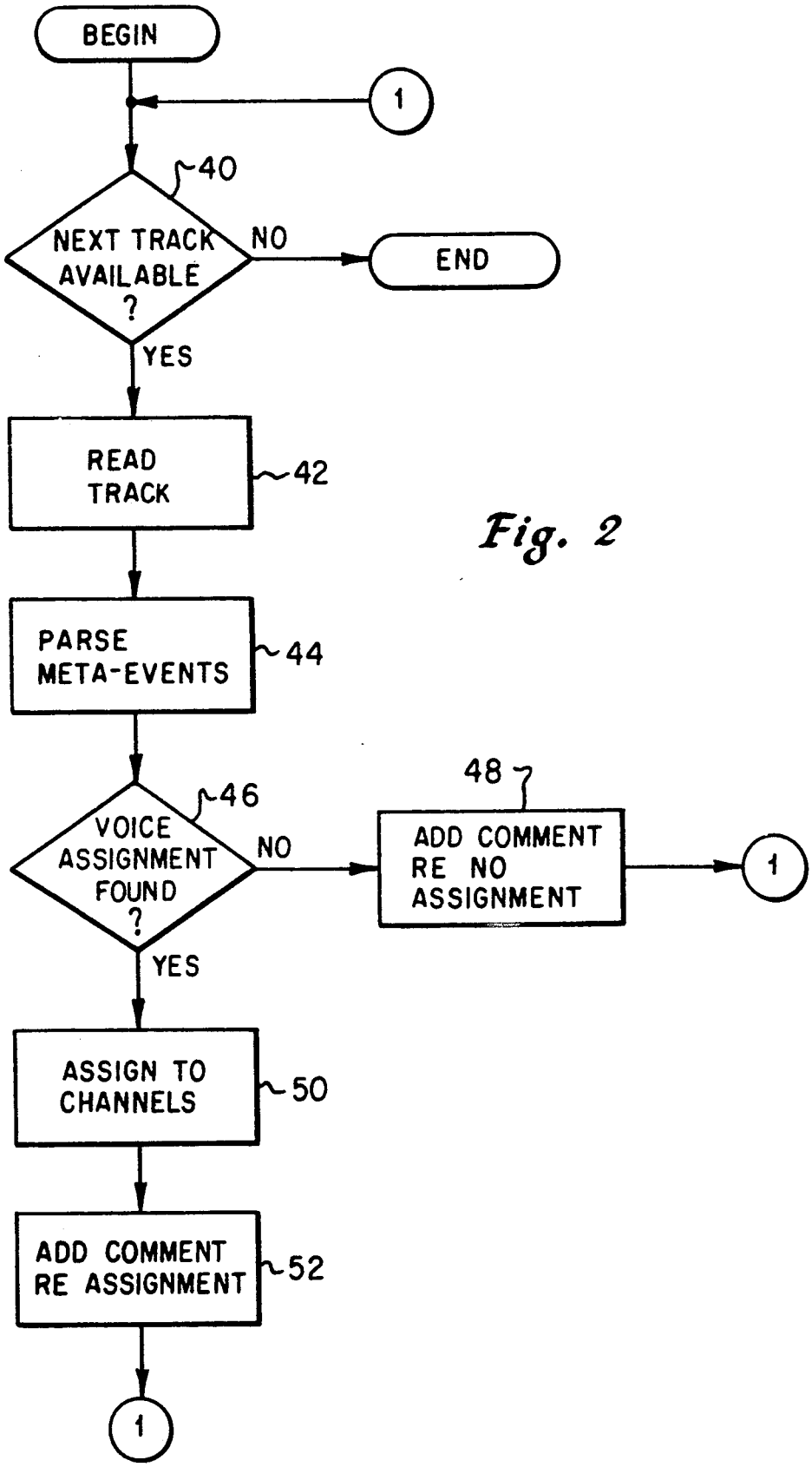
FIGS. 2 and 3 are flow charts illustrating various aspects of a preferred method according to the present invention.

Referring to FIG. 2, a high level flow chart of the operation of the importer 14 is shown. As will be appreciated by those skilled in the art, the steps shown in FIG. 2 describe operation of the converter 14 when the input file 12 is in MIDI format 1. As known in the art, a MIDI format 1 file has multiple tracks which will be merged into a single track (format 0) MIDI file. In a format 1 file, each track typically corresponds to a single musical instrument. However, one track may contain MIDI events for multiple voices on different channels.

Referring to FIG. 2, the importer first checks to see whether a track is available from the input file 40. If not, processing of the file has been completed, and the conversion process ends. If at least one track remains to be processed, the track is read 42 and metaevents are parsed 44. The parsing process 44 attempts to find voice assignments within the track, and map them to MIDI channels. If no voice assignment is found 46, a comment is added to the converted file that no assignment was made for this track. Control then returns to step 40.

If a voice assignment was found in step 46, voices are assigned to the appropriate channels 50, and a comment is added to the converted file 16 indicating which assignments were made. As described above, when a match is found on a track between a voice and a MIDI channel, it is placed into the converted file 16 as a system exclusive event for later interpretation by the device driver 22.

The parsing technique used in step 44 may be simple or complex, depending on the needs of the designer of the importer 14. A high level flow chart indicating a preferred approach is shown in FIG. 3.

Figure 3:
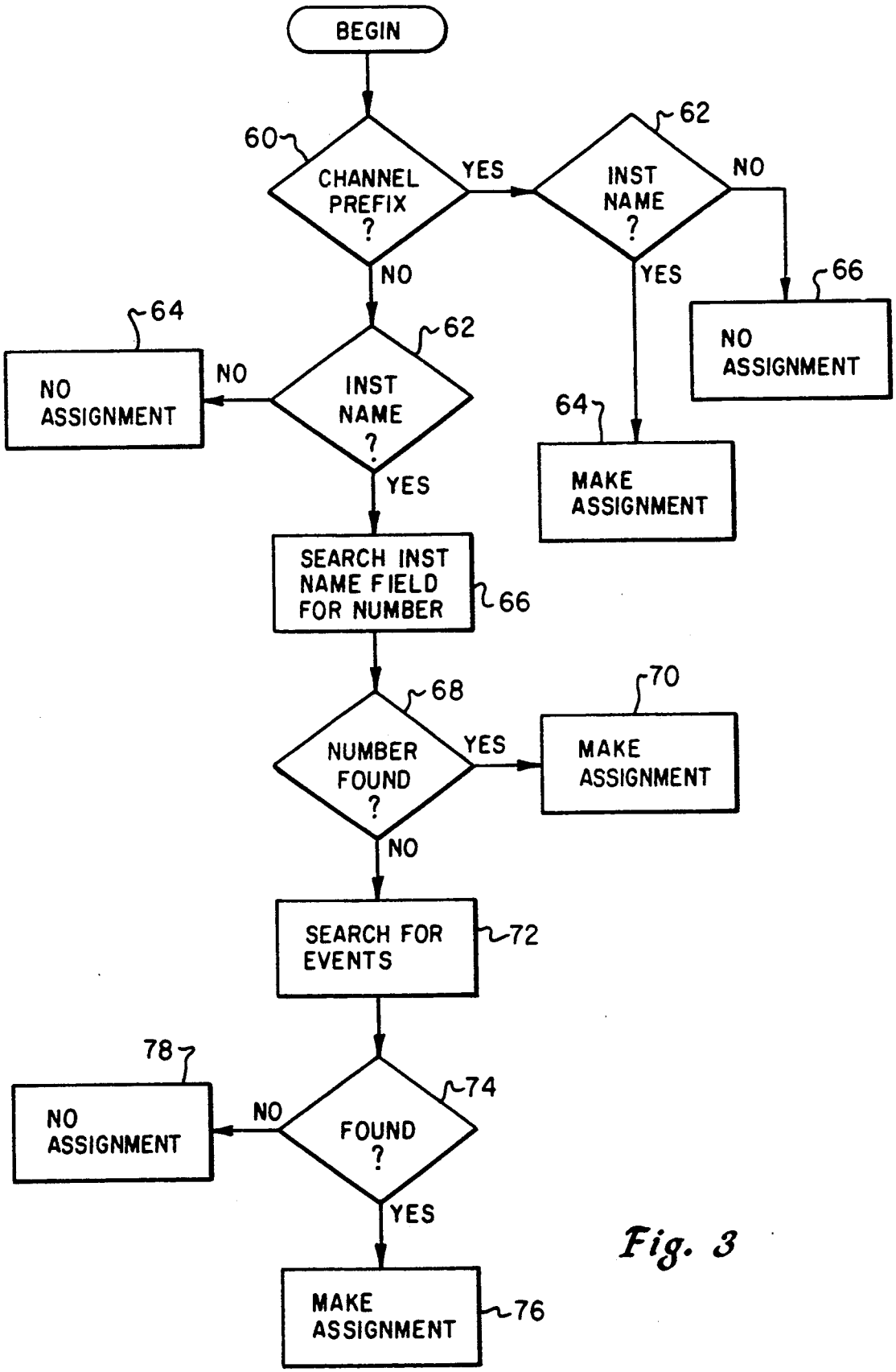

Referring to FIG. 3, a check is first made to see whether a channel prefix meta-event is contained on the track being parsed 60. A channel prefix meta-event indicates that all following meta-events relate to a MIDI channel number which is defined therein. If the channel prefix meta-event is found, the track is scanned to see whether an instrument name meta-event is contained in it 62.

The instrument name meta-event is typically used by those who prepare MIDI files to describe, in text, the instrument which is used for the current track. The text in the instrument name meta-event is scanned to see whether it contains a word which is recognized by the converter 14. Preferably, recognition is determined by simply comparing the words in the text of the instrument name meta-event to a table of instrument names and corresponding standard instrument numbers. If a match is found with an entry in the table, an instrument name has been recognized and an assignment of the corresponding instrument number is made. This will cause the yes branch to be taken in step 46 of FIG. 2. If no match is found in the table, or if there is simply no instrument name meta-event for this track, no voice assignment is made 66. This will cause the no branch to be taken from step 46 of FIG. 2.

If desired, sophisticated techniques can be used to parse the text in the instrument name meta-event. However, it has been found that a simple table text matching technique is sufficient in most cases. Alternative spellings for instruments may be placed in the table, each having the same corresponding instrument number. Thus, for example, if a piano was to be assigned standard instrument number 13, a look up table used by the converter 14 could contain entries for "piano" and "pianoforte", each having a corresponding instrument number 13. Whichever term was used in the instrument name meta-event, the correct instrument number (13) would be found and placed into the converted file 16.

If no channel prefix meta-event was found in step 60, a search is made through the track for an instrument name meta-event 62. If none exists, no assignment is made 64. If an instrument name metaevent was found in step 62, and an instrument name was included which matched an entry in an instrument name table as described above, the instrument name metaevent comment field is searched to see if any number is included 66. If a number is found 68, it is assumed to be a channel number corresponding to the instrument name, and an assignment is made 70 as described above.

If there is an instrument name meta-event containing a recognized name, but no corresponding channel number was found in step 68, it is still possible to make a good "guess" as to the channel number to be used for that instrument. This is done by searching the data in the track for various MIDI events 72, such as note-on and note-off events. Each of such events identifies a channel on which it occurs, and such channel can be assigned the voice corresponding to the instrument matched in step 62. If such a MIDI event is found 74, a voice to channel assignment is made 76 as described above. If no such events are found, no assignment is made 78.

FIG. 4 contains a pseudo code routine which can be used to implement the decision making outline to the flow chart of FIG. 3. As described above, if a MIDI channel prefix meta-event is found, the current track is presumed to correspond to the channel identified in such event. If an instrument name meta-event is found in the track, a corresponding voice and channel for the track is extracted from the text of the meta-event if possible. The remainder of the pseudo code shown in FIG. 4 implements the logical approach described in connection with FIG. 3.

FIGS. 5(*a*)–5(*c*) are simple examples illustrating handling of program change events by the system described above. FIG. 5 (*a*) shows portions of three tracks of an input MIDI file. FIG. 5 (*b*) shows a portion of a converted MIDI file 16 which has been converted into a format 0 (one track) MIDI file. FIG. 5 (*c*) shows a conversion table used by the converter 14 to translate the data in FIG. 5 (*a*) to that of FIG. 5 (*b*). Each entry in the conversion table of FIG. 5 (*c*) contains an instrument name, and a corresponding standard instrument number. Note that alternative (albeit incorrect) spellings have been included for both the tuba and the cymbal. If the person who originally wrote the text into the instrument name meta-event used one of the variant spellings, the converter will be able to recognize it and assign the proper voice to the channel.

In the input file, track 1 contains an instrument name Meta-Event, defining that track to include the trombone voice. No information is contained in track 1 to indicate which MIDI channel should be assigned to the trombone voice. However, note on events are contained within track 1 for both MIDI channel 3 and MIDI channel 4. This will cause the converter to assume that both MIDI channel 3 and MIDI channel 4 should be assigned the trombone voice.

Track 2 contains a MIDI channel prefix meta-event, defining all following Meta-Events as pertaining to channel 1. Later on track 2, an instrument name metaevent, containing the word tuba, is found. This means that MIDI channel 1 will be assigned the tuba voice.

Track 3 contains an instrument name meta-event, with the text "sassy violin on channel 2, and 5 for the cymbal". The word violin is recognized as appearing in the conversion table, and is assigned channel 2 which is the nearest number to the word violin. The cymbal voice is assigned to channel 5, since the number 5 is closest to the recognized word cymbal. Thus, the single instrument name meta-event shown in track 3 serves to assign voices to two different channels.

FIG. 5 (*b*) shows a system exclusive meta-event which can be included in the format 0 converted MIDI file 16 corresponding to the various meta-events shown in FIG. 5 (*a*). The system exclusive event assigned voice 3 to channel 1, voice 2 to channel 2, voice 1 to channels 3 and 4, and voice 4 to channel 5. The EOX marker is the end of system exclusive meta-event marker as described in the standard MIDI specification.

The device driver 22, if it is set to translate system exclusive events, will generate five separate program change events out of the system exclusive event of FIG. 5 (*b*). In addition, the standard voice number assignment included in the system exclusive event will be translated if necessary to correctly drive the synthesizer 26 by referring to the look up table 28.

A single system exclusive event is shown in FIG. 5 (*b*) to correspond to all of the meta-events of FIG. 5 (*a*), but each program change can be contained in a separate system exclusive event if desired. It is convenient to group several program changes into a single system exclusive event, especially when several of them occur at the beginning of the MIDI data file. However, program changes which occur at different times in the MIDI file will have to be contained in separate system exclusive events.

The system described above provides a technique for automatically determining MIDI channel voice assignments from a standard MIDI file. This allows many MIDI files to be placed on different synthesizers. Use of system exclusive events to contain the automatically extracted program changes allows extra flexibility in that either the original or the extracted program changes can be sent to the synthesizer by simply setting a flag in the device driver. Conversion of the extracted program changes from a standard voice numbering scheme to a numbering scheme expected by the synthesizer is easily performed using the look up table.

Different parts of the system can be used independently of other parts. The parsing technique described above can be used, if desired, to generate standard program change events to be placed into the converted file. It may be used independently of the technique of placing program change events inside system exclusive events for interpretation by a device driver. Similarly, the use of system exclusives as described above can be done independently of the described parsing technique. The use of a look up table and standard voice numbers can also be done independently of the parser and use of system exclusives. A device driver can simply translate all program changes according to the look up table.

While the invention has been shown in only one of its forms, it is not thus limited but is susceptible to various changes and modifications without departing from the spirit thereof.

I claim:

1. A system for processing MIDI data files, comprising:

an input file containing MIDI data including instrument voice textual information;

a converter for extracting said instrument voice textual information from the input file and assigning instrument voices to MIDI channels within a converted file in response to said extracted instrument voice textual information; and a sequencing system including means for reading said converted file and outputting a MIDI data stream to a receiving unit in response thereto.

2. The system of claim 1, wherein the instrument voice textual information is extracted from instrument name meta-events.

3. The system of claim 1, wherein said converter places assigned instrument voice information into MIDI system exclusive events.

4. The system of claim 3, wherein the outputting means comprises a device driver controlling a serial output device.

5. The system of claim 4, wherein said device driver can operate in one of two states, wherein during operation in the first state said device driver removes any MIDI program change events which occur in the data stream and generates program change events corresponding to instrument voice textual information contained in system exclusive events, and wherein in the second state said device driver leaves any program change events in the MIDI data stream and ignores any system exclusive events.

6. A method for processing MIDI data in an electronic computer system, comprising the steps of:

reading in a MIDI data file which includes instrument voice textual data;

extracting said instrument voice textual data from the data file; and assigning instrument voices to MIDI channels based on said extracted instrument voice textual data.

7. The method of claim 6, further comprising the step of: writing the MIDI data file and extracted instrument voice textual data data to a converted file.

8. The method of claim 7, further comprising the step of:

generating a MIDI data stream from the converted file.

9. The method of claim 8, further comprising the steps of:

sending the MIDI data stream to a device driver; and sending a corresponding MIDI data stream from the device driver to a MIDI compatible instrument.

10. The method of claim 9, wherein assigned instrument voices are placed into MIDI system exclusive events.

11. The method of claim 10, further comprising the steps of:

within the device driver, removing program change events from the data stream; and within the device driver, converting instrument voice assignments in system exclusive events to program change events and placing them in the data stream.

12. The method of claim 11, further comprising the steps of:

providing an indicator having at least two states, wherein a first state indicates that system exclusive events are to be converted to program change events and that program change events are to be removed from the data stream, and wherein a second state indicates that the data stream is to remain unaltered.

13. The method of claim 12, wherein a third indicator state indicates that system exclusive events are to be removed form the data stream.

* * * * *